United States Patent [19]

Masuda et al.

[11] 4,415,319

[45] Nov. 15, 1983

[54] PUMP UNIT

[75] Inventors: Naosuke Masuda; Takeshi Ohe; Tadaaki Fujii, all of Higashimatsuyama, Japan

[73] Assignee: Jidosha Kiki Co., Ltd., Tokyo, Japan

[21] Appl. No.: 291,874

[22] Filed: Aug. 11, 1981

[51] Int. Cl.[3] ..... F01C 11/00; F01C 19/08

[52] U.S. Cl. ..... 418/135; 418/212

[58] Field of Search ..... 418/13, 135, 210, 212, 418/215, 259, 266

[56] References Cited

U.S. PATENT DOCUMENTS

| | | | |
|---|---|---|---|
| 949,638 | 2/1910 | Stormer | 418/212 |
| 3,076,414 | 2/1963 | Adams | 418/135 |
| 3,311,064 | 3/1967 | Eichele | 418/135 |
| 3,438,570 | 4/1969 | Bode | 418/96 |

*Primary Examiner*—Leonard E. Smith
*Assistant Examiner*—Jane Obee
*Attorney, Agent, or Firm*—Flynn, Thiel, Boutell & Tanis

[57] ABSTRACT

A plurality of pump sections are received in a stack in a body. Each of the pump sections include a cam ring disposed in surrounding relationship with a rotor having vanes thereon, and a pair of sideplates which closes the opposite sides of the cam ring. All of the pump sections are driven by a common drive shaft, thereby providing a compact pump unit having a reduced axial length. The outermost sideplates are subject to a discharge pressure from the respective pump sections to urge the various components of the individual pump sections to be held against the body. In this manner, the components are maintained at given accurate locations, eliminating the likelihood of a liquid leakage and simplifying the arrangement.

3 Claims, 2 Drawing Figures

PUMP UNIT

FIELD OF THE INVENTION

The invention relates to a pump unit, and more particularly, to a pump unit including a plurality of pump sections of a vane type which are driven by a common drive shaft.

BACKGROUND OF THE INVENTION

A pump unit is known in the art in which a pair of pump sections of a vane type are adapted to be driven by a common drive shaft. In the conventional arrangement, a pair of vane pumps are simply interconnected. In other words, the bodies of the individual vane pumps are connected together to permit a shared use of a drive shaft. Consequently, the body is interposed between the pump sections to increase the spacing therebetween, resulting in an increased overall size of the pump unit. In addition, the drive shaft which is used to drive the individual pump sections must have an increased rigidity. Another disadvantage relates to the time and labor which is required to assemble the single pump unit and which is substantially equal to the time and labor required to assemble a pair of vane pumps.

SUMMARY OF THE INVENTION

It is therefore an object of the invention to provide a pump unit which is reduced in size and weight and easy to assemble.

In accordance with the invention, there is provided a pump unit including a plurality of pump sections of a vane type, each of which is driven by a common drive shaft to provide a pumping action. The pump unit is characterized by an opening which is formed in a body, in which opening the individual pump sections are received in mutual contact with each other. This permits the axial length of the drive shaft to be reduced as compared with the prior art. Accordingly, the rigidity required of the drive shaft may be reduced, or alternatively the wobbling of the drive shaft may be reduced to decrease a pulsation in the discharge pressure from the respective pump sections. The plurality of pump sections which are maintained in mutual contact with each other permit them to be integrally assembled together in a sequential manner.

According to another aspect of the invention, the individual pump sections are received in the opening formed in the body of the pump unit in a manner to permit their axial displacement while maintaining them in mutual contact with each other. Each pump section is defined by respective sideplates, and at least one of the sideplates which is located outermost is subject to a discharged pressure from the associated pump section. In this manner, such discharge pressure can be utilized to maintain the components of the individual pump sections in a required urged position. Since the components are properly maintained in this manner, a liquid leakage between adjacent components is prevented, contributing to a further improvement of the pump performance while simultaneously simplifying the assembly.

Above and other objects, features and advantages of the invention will become apparent from the description to follow which is given in connection with the accompanying drawing.

DESCRIPTION OF EMBODIMENT

Figure 1:
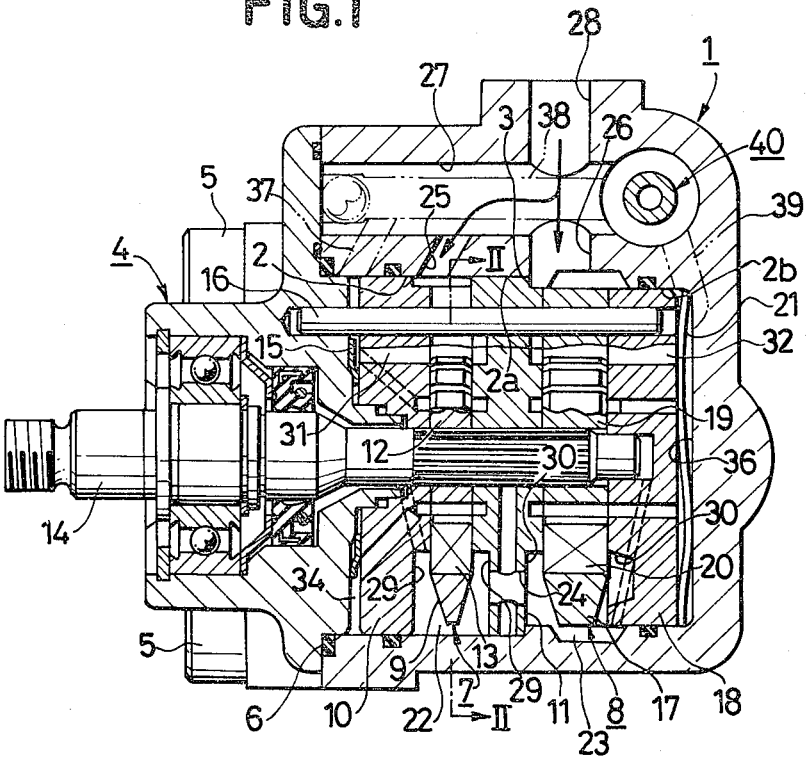
FIG. 1 is a cross section of one embodiment of the invention.
Figure 2:
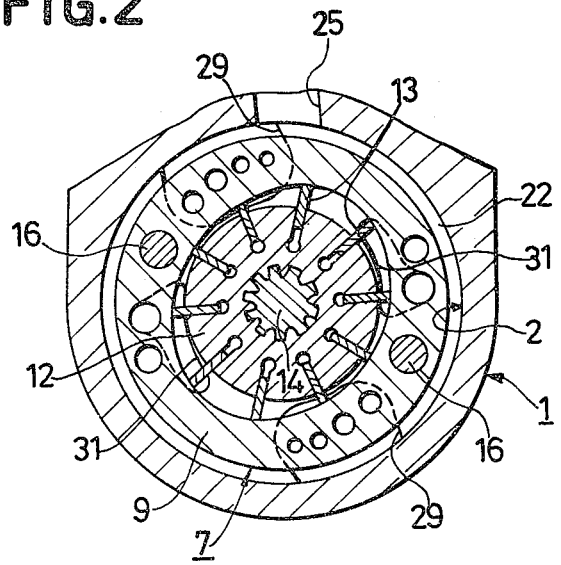
FIG. 2 is a cross section taken along the line II—II shown in FIG. 1.

Referring to FIGS. 1 and 2, the pump unit shown includes a housing composed of rear body 1 in which an opening 2 is formed with its one end being closed. A step 3 is formed substantially at the center of the opening 2, providing an opening 2*a*, of an increased diameter toward the front side and an opening 2*b* of a reduced diameter toward the bottom side or closed end. The housing of the pump unit also includes a front body 4 which is secured to the rear body 1 by means of bolts 5, with a seal 6 interposed therebetween. A first pump section 7 and a second pump section 8 are received in the opening 2.

The first pump section 7 is constructed similar to a conventional vane pump, and comprises a cam ring 9 having a cam surface formed along its inner periphery, a pair of sideplate 10,11 disposed to close the opposite end faces of the cam ring 10, a rotor 12 which is rotatable within the cam ring 6, a plurality of vanes 13 provided on the rotor 12, and a drive shaft 14 to which the rotor 12 is splined to be driven thereby for rotation. The sideplate 10 which is located within the larger opening 2*a* has an outer diameter which is equal to the inner diameter of such opening, and is slidably fitted therein. The other sideplate 11 which is disposed in the region of the step 3 has a stepped configuration so as to be simultaneously fitted into the both openings 2*a*, 2*b* with a step between such portions disposed in abutment against the step 3. A spring 15 is interposed between the front body 4 and the sideplate 10 for urging the entire first pump section 7 in a rearward direction to maintain the step formed in the sideplate 11 in abutment against the step 3 formed in the opening 2. In this manner, the axial position of the first pump section 7 is controlled while preventing a liquid leakage during a pumping operation. The front body 4 is provided with a pair of positioning pins 16 which extend through the opening 2 in parallel relationship with the drive shaft 14. The positioning pins slidably extend through the cam ring 9 and the pair of sideplates 10, 11, which form the first pump section 7, adjacent their outer periphery, thereby angularly positioning the cam ring 9 relative to the pair of sideplates 10, 11.

The second pump section 8 is constructed in essentially the same manner as the first pump section 7, but shares the sideplate 11, which is located between the two pump sections (hereinafter sometimes referred to as the common sideplate), and the drive shaft 14 with the first pump section 7. Specifically, the second pump section 8 comprises a cam ring 17, a pair of sideplates 11, 18 including the sideplate 11 mentioned above, a rotor 19, vanes 20 and the drive shaft 14 to which the rotor 19 is splined to be driven thereby for rotation. The cam ring 17, the rotor 19 and the vanes 20 of the second pump section 8 have axial dimensions which are greater than those of the first pump section 7, so that the second pump section 8 has a greater capacity than the first pump section 7. The sideplate 18 has an outer diameter which is equal to the inner diameter of the opening 2*b* and is slidably fitted therein. A spring 21 having a reduced resilience as compared with the spring 15 is interposed between the sideplate 18 and the bottom of the opening 2 to urge the components of the second pump section 8 in a direction toward the central sideplate 11 which is positioned by the step 3 and the spring 15 in the manner mentioned above. The positioning pins 16 also slidably extend through the cam ring 17 and the sideplate 18 of the second pump section 8, in a region adjacent to the outer periphery, thus angularly positioning the cam ring 17 relative to the sideplate 18. It is desirable that the cam rings 9, 17 of the two pump sections 7, 8 be disposed out of phase, as viewed in the direction of rotation of the drive shaft 14, so that pulsations occurring in the discharge pressure from one of the pump sections be out of phase from pulsations in the discharge pressure from the other pump section, with an overall effect that a smooth pumping action is achieved.

Low pressure chambers 22, 23, representing the suction side of the pump unit, are formed in the clearance between the outer periphery of the cam rings 9, 17 and the inner periphery of the opening 2, and communicate with each other through a communication hole 24 formed in the central sideplate 11. These low pressure chambers 22, 23 communicate, through a pair of passages 25, 26 formed in the rear body 1 and through a transverse passage 27 providing a communication between these passages, 25, 26, with a fluid intake port 28 which opens into the body 1, and also communicate with the interior of the resepective pump sections 7, 8 through intake openings 29, 30 which are formed in the pairs of sideplates 10, 11 and 11, 18 at given positions.

Discharge openings 31, 32 are formed in the pairs of sideplates 10, 11 and 11, 18 at given positions. The discharge opening 31 of the first pump section 7 communicates with a high pressure chamber 34 in which the spring 15 is disposed while the discharge opening 32 of the second pump section 8 communicates with a high pressure chamber 36 in which the spring 21 is disposed. As indicated by phantom lines in FIG. 1, each of the high pressure chambers 34, 36 communicates with an associated discharge port, not shown, either directly or through a flow control valve 40, disposed within the rear body 1, through passages 37, 38 and 39 which are formed at locations where they do not communicate with the passages 25, 26, 27 and 28 of the intake side.

The flow control valve 40 is well known in the art, and hence its specific construction and operation will not be described. Any conventional arrangement may be used as the flow control valve 40. Alternatively, a flow control valve of the type disclosed in Japanese Laid-Open Patent Application No. 14,923/1980 may be used which permits the entire discharge from the discharge ports to be supplied to a fluidic instrument as long as the discharge from the respective pump sections 7, 8 is small, but which causes part of the discharge from the pump section 8 to be bypassed when its discharge reaches a given value, with the amount of bypass being eventually increased to the full discharge from the pump section 8.

During assembly, the drive shaft 14 and the positioning pins 16 are initially mounted in the front body 4, and then the spring 15, the first pump section 7, the second pump section 8 and the spring 21 are sequentially assembled on the drive shaft 14 and the positioning pins 16 so as to be received in the opening 2 of the rear body 1. The front body 4 may then be connected together with the rear body 1 by means of the bolts 5, thus completing the assembly with labor and time which is substantially comparable to the assembly of a single vane pump. In particular, since the sideplate 11 is shared by the both pump sections 7, 8 in the present embodiment, the number of parts as well as the weight are reduced while permitting the spacing between the both pump sections 7, 8, in particular, between the cam rings 9, 17 to be reduced. Since the opening 2 has a bottom or end wall, it can be closed by a single lid member or front body 4. Again, the number of parts as well as the weight can be reduced as compared with an arrangement in which the opening 2 is formed as a through-opening to be closed at its both ends. This also contributes to simplifying the assembly and preventing a liquid leakage. In addition, the positioning pins 16 serve adjusting the phase relationship between the cam rings 9, 17 and the sideplates 10, 11 and 18. It is to be particularly pointed out that if the first pump section 7 and the second pump section 8 are disposed to be out of phase with respect to each other, they can be easily assembled to a given phase relationship and with a high accuracy.

Operation

In operation, as the drive shaft 14 rotates, the rotors 12, 19 of the respective pump sections 7, 8 are driven for rotation, thus withdrawing the fluid present in the individual low pressure chambers 22, 23 into the space defined by the respective vanes 13, 20 through the intake openings 29, 30, generally in the same manner as in a conventional vane pump. Thereafter, the fluid withdrawn is discharged into the respective high pressure chambers 34, 36 through the individual discharge openings 31, 32. The discharge pressure introduced into each high pressure chamber urges the components of the respective pump sections 7, 8 in the same manner as achieved by the resilience of the springs 15, 21 disposed in the respective high pressure chambers. However, it will be noted that the outermost sideplates 10, 18 are subject to the discharge pressure. Obviously, the sideplate 10 which is fitted into the larger opening **2*a* has a greater surface area which is subject to the pressure, so that the central sideplate 11 is held in abutment against the step 3 in the same manner as such abutment is achieved by a differential resilience between the springs 15, 21. The components of the respective pump sections 7, 8 are sequentially disposed in abutment against each other with the sideplate 11 located at the center. Consequently, no careful attention is required during the assembly, the only requirement being that the components be manufactured to given accuracies. The various components are then urged to and maintained at given axial positions referenced to the sideplate 11 under the resilience of the springs 15, 21 and the discharge pressure, in a manner to prevent any liquid leakage therebetween. As an alternative arrangement, the sideplate 18 disposed within the smaller opening 2*b* may be chosen as a reference member, against which other components of the pump sections 7, 8** may be disposed in abutment.

The hydraulic fluid discharged into the high pressure chambers 34, 36 is fed through the passages 37, 38 and 39 to the flow control valve 40 where the flow rate is controlled in accordance with the design of the valve, to be supplied to the fluidic instrument through discharge port, not shown. The fluid from the instrument is returned into the rear body 1 through the intake port 28, and then fed through the passages 27, 26 and 25 into the low pressure chambers 22, 23.

While the pump sections 7, 8 are of a vane type shown in the embodiment described above and are of a balanced pressure type, it should be understood that the invention is equally applicable to any other type of vane pumps including a pressure imbalance type.

While the invention has been particularly shown and described above in connection with a particular embodiment thereof, it should be understood that various modifications and changes will readily occur to those skilled in the art without departing from the spirit and scope of the invention. Therefore, it is intended that the scope of the invention be solely defined by the appended claims.

The embodiments of the invention in which an exclusive property or privilege is claimed are defined as follows:

1. A vane-type pump unit, comprising:

a housing having a circular opening therein with a first section having a first diameter and a second section having a second diameter greater than said first diameter so that a step is formed therebetween;

first and second axially spaced pump sections received in said opening, one of said pump sections having a diameter conforming to one of said first and second diameters, the other of said pump sections having a diameter conforming to the other of said first and second diameters, said pump sections together having three axially spaced sideplates, one of said sideplates being oriented between said pump sections and defining a common sideplate, said common sideplate having a stepped peripheral surface thereon conforming to each said first and second diameters, said step between the peripheral surfaces on said common sideplate engaging sid step in said opening in said housing, said first pump section confirming to said first diameter of said housing and having a first cam ring with a first cam surface thereon, and includes a first sideplate and a first side portion of said common sideplate straddling said first cam ring, said second pump section conforming to said second diameter of said housing and having a second cam ring with a second cam surface thereon, and includes said second sideplate and a second side portion of said common sideplate straddling said second cam ring;

a shaft having a pair of axially spaced rotors thereon radially aligned with a respective one of said first and second cam rings and said cam surfaces thereon, each said cam surface having a central axis radially offset from the axis of said shaft and said rotors mounted thereon, each said rotor having plural vanes reciprocally mounted thereon and slidingly engaging said respective cam surface;

first means defining an inlet for supplying fluid to a first region between a selected number of vanes of each pump section;

second means defining an outlet from a second region between a selected number of other vanes of each pump section for facilitating the outflow of pressurized fluid therefrom, said second means including a passageway communicating with (1) a first space between a first axially facing surface on said first sideplate and a first opposing surface on said housing and (2) a second space between a second axially facing surface on said second sideplate and a second opposing surface on said housing; and first resilient means in said first space and second resilient means in said second space, said second resilient means being stronger than said first resilient means whereby it is effected that said first and second sideplates and associated first and second cam rings are urged toward said common sideplate and into tight engagement with each other, and said common sideplate is urged into engagement with and maintained in engagement with said step in said opening in said housing and, in addition, said pressurized fluid is supplied to said first and second spaced to further assist said first and second resilient means.

2. A pump unit according to claim 1, in which said housing comprises a rear body in which an opening having a bottom is formed and a front body in the form of a lid member which closes the opening, said front body and said rear body being connected together by a fastening means after the respective pump sections are received within said opening.

3. A pump unit according to claim 2, in which said front body carries a positioning pin which extends into said opening in parallel relationship with said shaft, said positioning pin extending through said first and second cam rings and said three sideplates which form each of said pump sections, thereby controlling the angular position of each of said cam rings with respect to the associated ones of said sideplates.

* * * * *

UNITED STATES PATENT AND TRADEMARK OFFICE

CERTIFICATE OF CORRECTION

PATENT NO. : 4 415 319

DATED : November 15, 1983

INVENTOR(S) : Naosuke Masuda, Takeshi Ohe and Tadaaki Fujii

It is certified that error appears in the above-identified patent and that said Letters Patent is hereby corrected as shown below:

Col. 5, line 31; change "sid" to ---said---.

Col. 5, line 33; change "confirming" to ---conforming---.

Signed and Sealed this

*Fifteenth* Day of *May 1984*

[SEAL]

*Attest:*

GERALD J. MOSSINGHOFF

*Attesting Officer*

*Commissioner of Patents and Trademarks*